US007827827B2

(12) United States Patent
Rawls

(10) Patent No.: US 7,827,827 B2
(45) Date of Patent: Nov. 9, 2010

(54) PORTABLE YARN CARRYALL DEVICE

(76) Inventor: John Rawls, 6205 TC Walker Rd., Gloucester, VA (US) 23061

( * ) Notice: Subject to any disclaimer, the term of this patent is extended or adjusted under 35 U.S.C. 154(b) by 0 days.

(21) Appl. No.: 12/586,479

(22) Filed: Sep. 23, 2009

(65) Prior Publication Data

US 2010/0101279 A1 Apr. 29, 2010

Related U.S. Application Data

(60) Provisional application No. 61/197,558, filed on Oct. 28, 2008.

(51) Int. Cl.
*D04B 35/00* (2006.01)

(52) U.S. Cl. ..... 66/1 A; 223/107

(58) Field of Classification Search ..... 66/1 A, 66/1 R; 223/106, 107
See application file for complete search history.

(56) References Cited

U.S. PATENT DOCUMENTS 742,719 A * 10/1903 Mcdowell ..... 223/106
810,292 A * 1/1906 Meaker ..... 223/106
820,596 A * 5/1906 Norwood ..... 225/38
973,861 A * 10/1910 Eidam ..... 223/106
1,061,590 A * 5/1913 Bennet ..... 223/106
1,277,956 A * 9/1918 Leach ..... 223/106
1,405,554 A * 2/1922 Northcraft ..... 242/129.6
1,714,362 A * 5/1929 Grimes ..... 223/106
2,278,209 A * 3/1942 Moore ..... 150/123
2,401,667 A * 6/1946 Segur ..... 223/107
2,962,199 A * 11/1960 Kier ..... 225/37
3,093,277 A * 6/1963 Mann ..... 223/106
3,145,646 A * 8/1964 Levy ..... 100/34
4,111,341 A * 9/1978 Carrozo ..... 223/106
4,186,833 A * 2/1980 Homan ..... 206/225
4,909,457 A * 3/1990 Johnson ..... 242/138
4,991,410 A * 2/1991 Donatelli ..... 66/1 A
5,005,380 A * 4/1991 Downey ..... 66/1 A
5,544,499 A * 8/1996 Boggs ..... 66/1 A

* cited by examiner

*Primary Examiner*—Danny Worrell

(57) ABSTRACT

A yarn carryall device comprising a portable chassis with a plurality of knitting accessory holders. The chassis comprises at least one spool cradle wherein the at least one spool cradle is configured to freely rotate therein at least one spool in a horizontal orientation. The device includes a plurality of knitting accessory holders coupled to the portable chassis. The spool may be empty so that a batch of yarn may be uploaded onto the spool for dispensing during the knitting or crocheting process.

9 Claims, 9 Drawing Sheets

PORTABLE YARN CARRYALL DEVICE

COPENDING APPLICATIONS

This application claims priority benefit of Provisional Patent Application No. 61/197,558 filed Oct. 28, 2008, titled "Yarn Carry All" having the same inventor.

NOTICE OF COPYRIGHT PROTECTION

A portion of the disclosure of this patent document and its figures contain material subject to copyright protection. The copyright owner has no objection to the facsimile reproduction by anyone of the patent document or the patent disclosure, but otherwise reserves all copyrights whatsoever.

BACKGROUND

I. Field

The invention relates to a portable yarn carrying device.

II. Background

Keeping knitting supplies such as the yarn spools or skeins, knitting needles, crocheting hooks, scissors and other accessories in an organized manner has been a challenge. Currently, totes such as bags with pockets to place various supplies are available. However, these bags do not assist the knitter in the knitting process or aid in rapid removal and retrieval of the supplies on demand. Instead, the knitter typically must rummage through the bag to find the supplies needed.

For many years, crochet yarn has been available on tubular-shaped spools and cone-shaped spools. For convenience, the yarn is pulled directly from the spools while knitting or crocheting. Since the spools are tubular in shape, such spools have a tendency to roll or tip over and roll and unravel, as the yarn is pulled. When the yarn unravels, the yarn may become tangled or soiled. As can be appreciated, controlling multiple spools of yarn when knitting with different yarns or yarn colors is even more challenging and frustrating to the knitter.

SUMMARY

The aforementioned problems, and other problems, are reduced, according to exemplary embodiments, by the devices and methods for carrying and organizing knitting or crocheting supplies, tools, accessories, yarn and at least one work.

According to an exemplary embodiment, a yarn carryall device is provided. The yarn carryall device comprises a portable chassis comprising at least one spool cradle, the at least one spool cradle being configured to freely rotate therein at least one spool in a horizontal orientation to dispense yarn. The device also includes a plurality of knitting accessory holders coupled to said portable chassis.

Other systems, methods, and/or products according to embodiments will be or become apparent to one with skill in the art upon review of the following drawings, and further description. It is intended that all such additional systems, methods, and/or products be included within this description, be within the scope of the present invention, and be protected by the accompanying claims.

DESCRIPTION OF THE DRAWINGS

The above and other embodiments, objects, uses, advantages, and novel features of this invention are more clearly understood by reference to the following description taken in connection with the accompanying figures, wherein.

DESCRIPTION

Figure 1:
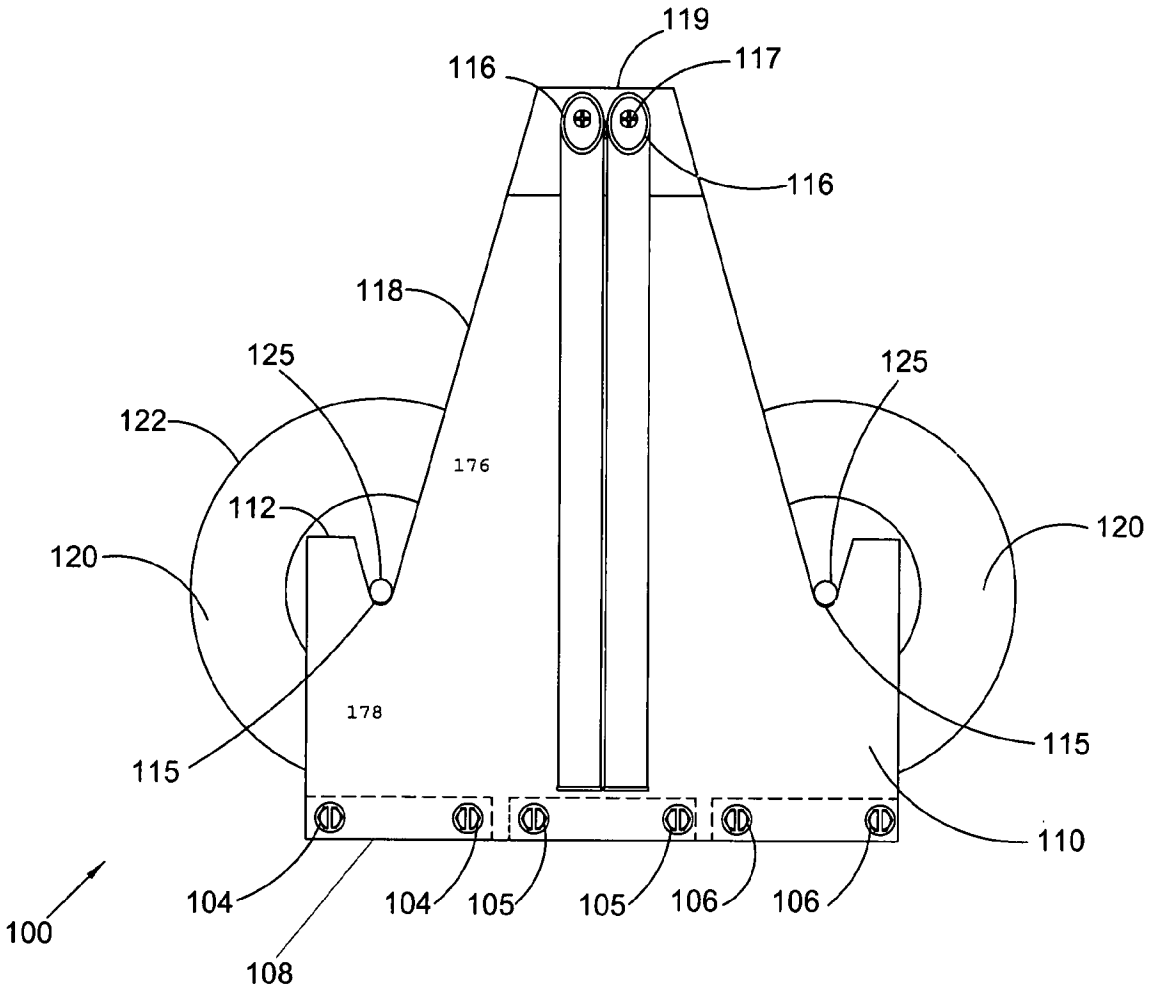
FIG. 1 is a front view of a portable yarn carryall device according to some exemplary embodiments of the present invention.
Figure 2:
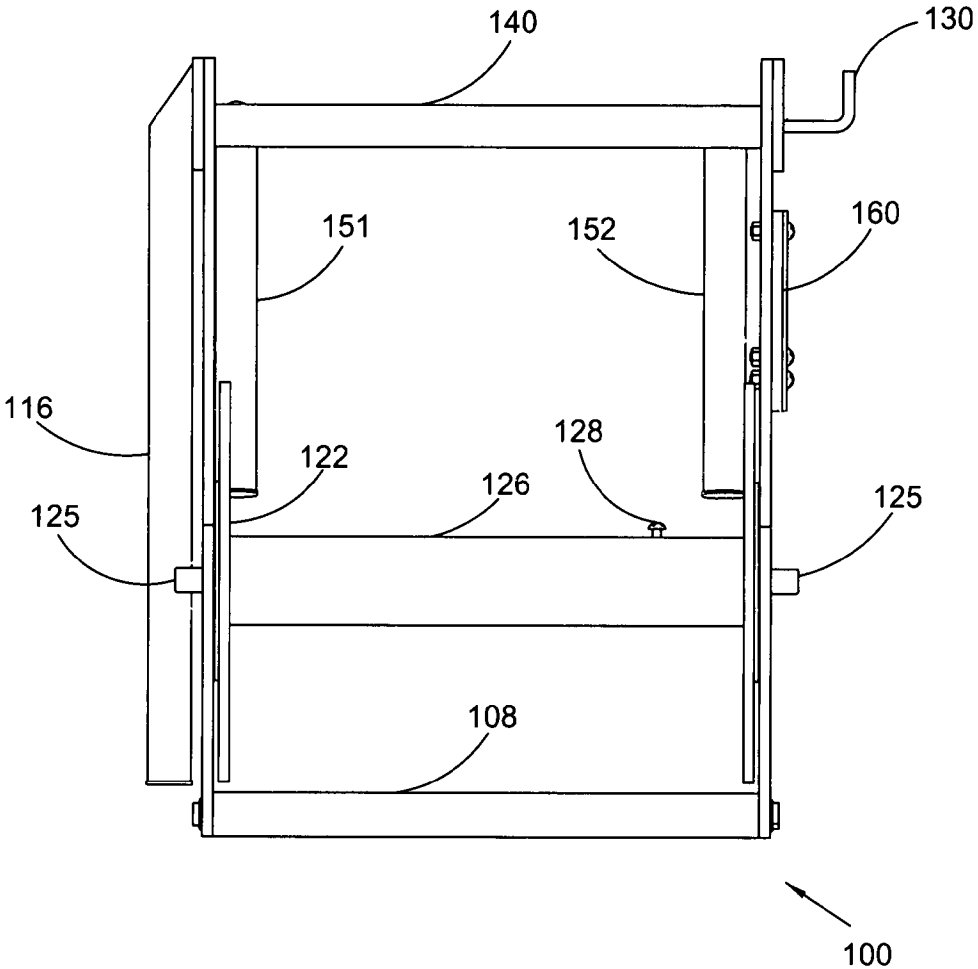
FIG. 2 is a side view of the portable yarn carryall device according to some exemplary embodiments of the present invention.

The word "exemplary" is used herein to mean "serving as an example, instance, or illustration." Any configuration or design described herein as "exemplary" is not necessarily to be construed as preferred or advantageous over other configurations or designs. Furthermore, use of the words "present invention" is used herein to convey only some of the embodiments of the invention. For example, the word "present invention" would also include alternative embodiments and equivalent systems and components that one of ordinary skill in the art understands. An example is that the materials used for the exemplary embodiments may be made out of man-made materials, natural materials, and combinations thereof. A further example is that the apparatus or components of the apparatus may be manufactured by machine(s), human(s) and combinations thereof.

Some of the embodiments of the invention now will be described more fully hereinafter with reference to the accompanying drawings, in which exemplary embodiments are shown. This invention may, however, be embodied in many different forms and should not be construed as limited to the embodiments set forth herein. These embodiments are provided so that this disclosure will be thorough and complete and will fully convey the scope of the invention to those of ordinary skill in the art. Moreover, all statements herein reciting embodiments of the invention, as well as specific examples thereof, are intended to encompass both structural and functional equivalents thereof. Additionally, it is intended that such equivalents include both currently known equivalents as well as equivalents developed in the future (i.e., any elements developed that perform the same function, regardless of structure).

According to exemplary embodiments, the portable yarn carryall device includes a chassis with a handle, the chassis being configured to arrange, store and carry knitting and/or crocheting supplies and to assist in the easy supply of yarn from one or more spools of yarn during the knitting process. The portable yarn carryall device is configured to be portable in nature to carry and arrange knitting and/or crocheting supplies such as, without limitation, scissors, yarn, knitting or crocheting needles, knitting wheels, sock blockers, stitch markers, yarn cutters, etc.

In an exemplary embodiment, the yarn carryall device provides a portable yarn supply device configured to carry multiple spools of yarn for easy supply of yarn in knitting and/or crocheting operations. In one embodiment, a plurality of yarns may be simultaneously used in the knitting or crocheting process.

In an exemplary embodiment, the yarn carryall device is configured to allow empty spools to be loaded, filled or spooled with an amount of yarn. For example, in an exemplary embodiment, a loop of an end of yarn is placed over a head of a screw in an unfilled or empty spool of said device. The user can rotate the empty or unfilled spool to upload a supply of yarn and have it wound around the device spool until some or all of the yarn is rotated around (loaded on, filled on or spooled on) the device spool. The rotation of the device spool can be accomplished by hand or by a drill to speed up the process.

The yarn carryall device includes a chassis which includes first knitting accessory holders, second knitting accessory holders, one or more removable and rotatable spools, a carry handle and third knitting accessory holder to hold or hand a work or other knitting supplies or articles (e.g., stitch markers, knitting wheel, sock blocker, yarn, etc.).

In an exemplary embodiment, the first knitting accessory holders are knitting or crochet needle holders. The second knitting accessory holders hold scissors and a needle. The third knitting accessory holder includes at least one hook or means for hanging a work or knitting tools, accessories or supplies. The "work" may include a line of knitted or crocheted stitches, a partially completed knitted article or crocheted articles, a completed knitted or crocheted article, other knitting supplies or other suitable objects for performing a knitting operation. For example, if the user is knitting a hat or something else that can be set onto a frame, then the frame can be hung on the side of the carryall device to keep the knitting that is being worked on with the yarn in a carryall device. Thus, the knitter need not worry about the hat, the sweater, the booties, etc. getting all tangled up or misplaced.

The present invention contemplates a portable, yarn carryall device and a corresponding method for using the portable yarn carryall device in order to carry, hold arrange and organize multiple yarn spools/skeins, knitting/crocheting tools and/or accessories such as, without limitation, scissors, knitting needles, crochet hooks, sewing needles, looping devices, stitch markers, yarn cutters, sock blockers, etc.

Furthermore, the yarn carryall device and associated method solve the problem of tangling and, especially, when more than one spools of yarn are used simultaneously in knitting process. The device spool is constructed and arranged with flanges at opposite ends of a length of spool to allow the user to place multiple packs of yarn on each spool. The device spool is configured to be rotated and cradled by the chassis to minimize or eliminate tangling of the yarn.

The portable yarn carryall device may be made of a variety of materials, such as, for example, wood, plastic or polyethylene composites, metals, other natural materials, other synthetic materials and combinations thereof.

According to some of the exemplary embodiments, the yarn carryall device may be a variety of sizes to support and cradle multiple spool yarn simultaneously. Each spool may support yarn of different thickness, compositions and color.

More particularly, this invention relates to a portable yarn carrying device that includes multiple yarn dispensing and winding means, a carrying handle and a hanging means.

Referring now to FIGS. 1-6, the portable yarn carrying device 100 includes a chassis 118 having base member 108. In the exemplary embodiment, the base member 108 has a rectangular configuration with a length that is at least as long as an ordinary skein or spool of yarn and a width for at least two skeins or spools arranged in parallel along a horizontal plane with a separation or gap adjacent skeins or spools. In the exemplary embodiment, the base member 108 has enough weight so that the chassis 118 will not tip over under the tug and pulls of yarn by the user when knitting or crocheting.

The chassis 118 further includes two side wall members 110. The two side wall members 110 are parallel to each other and perpendicular to the base member 108. In the exemplary embodiment, the side wall members 110 are detachably connected to base member 108 by fasteners or screw (bolt) members 104, 105, and 106 or other fastening means in such a way that side wall members 110 create vertically upright end walls at opposite ends of the base member 108.

In an alternate embodiment, the base member 108 and side wall members 110 may be integrated into a single unitary chassis body. The base member 108 may be made of a first material while the side wall members 110 are made of a second material, wherein the first material and the second material are different. Alternately, the first material and the second material are the same material.

The chassis 118 of the portable yarn carrying device 100 includes a carrying handle 140 connected to and between the side wall members 110. The carrying handle 140 comprises a hollow or solid elongated member that may be cylindrically shaped or has other geometric or non-geometric shapes that can be gripped by the user. The carrying handle 140 may be gripped by a user's hands to carry the portable yarn carryall device 100 from one place to another place. In the exemplary embodiment, the cylindrically shaped carrying handle 140 also can be used to hang an article, knitted article or work (e.g., half finished hanging place like sweater or shocks, etc.) or knitting supplies capable of being draped over the handle 140.

Figure 4:
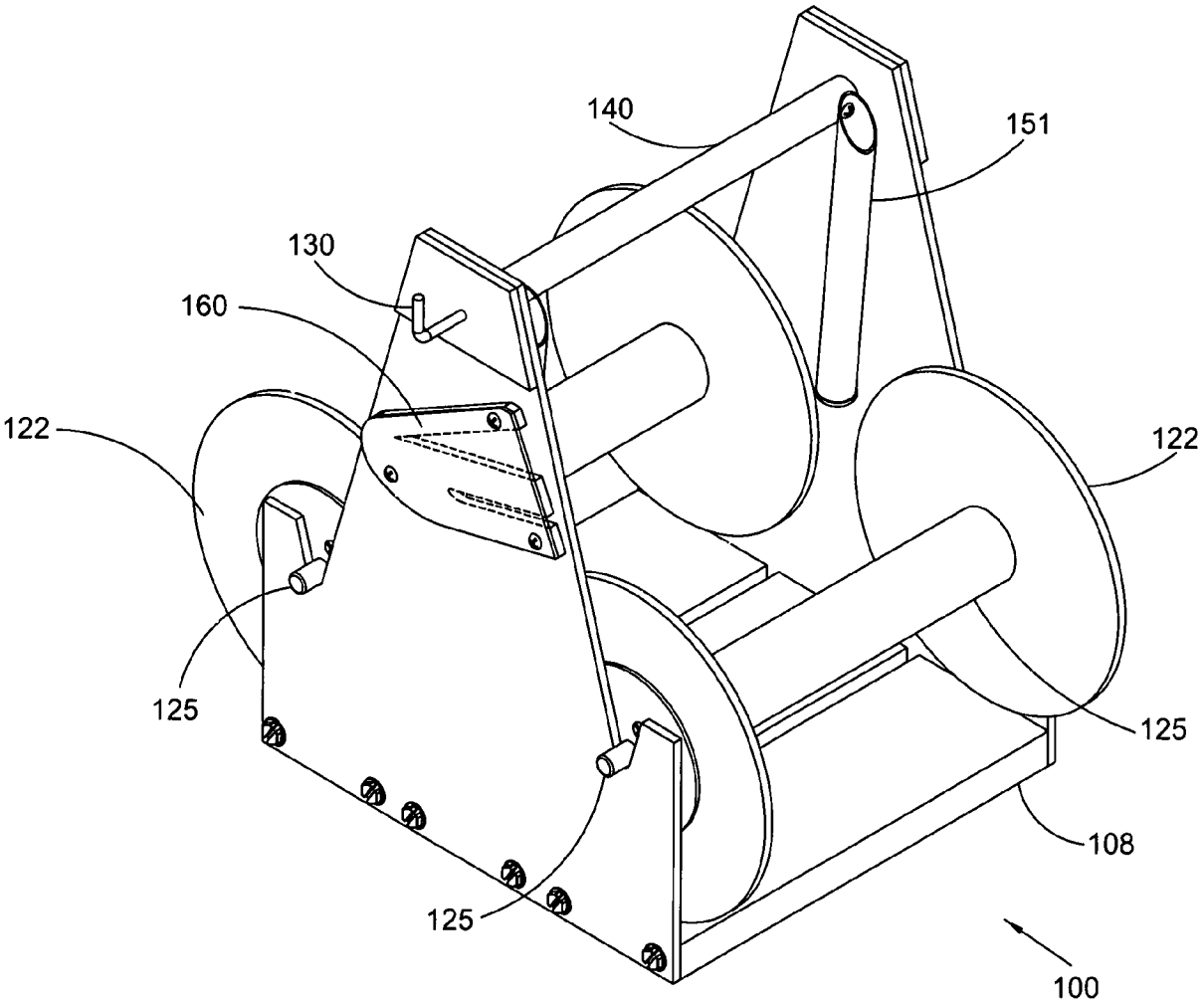
FIG. 4 is a perspective view from a rear view of the portable yarn carryall device in accordance with some of the exemplary embodiments of the present invention.
Figure 5:
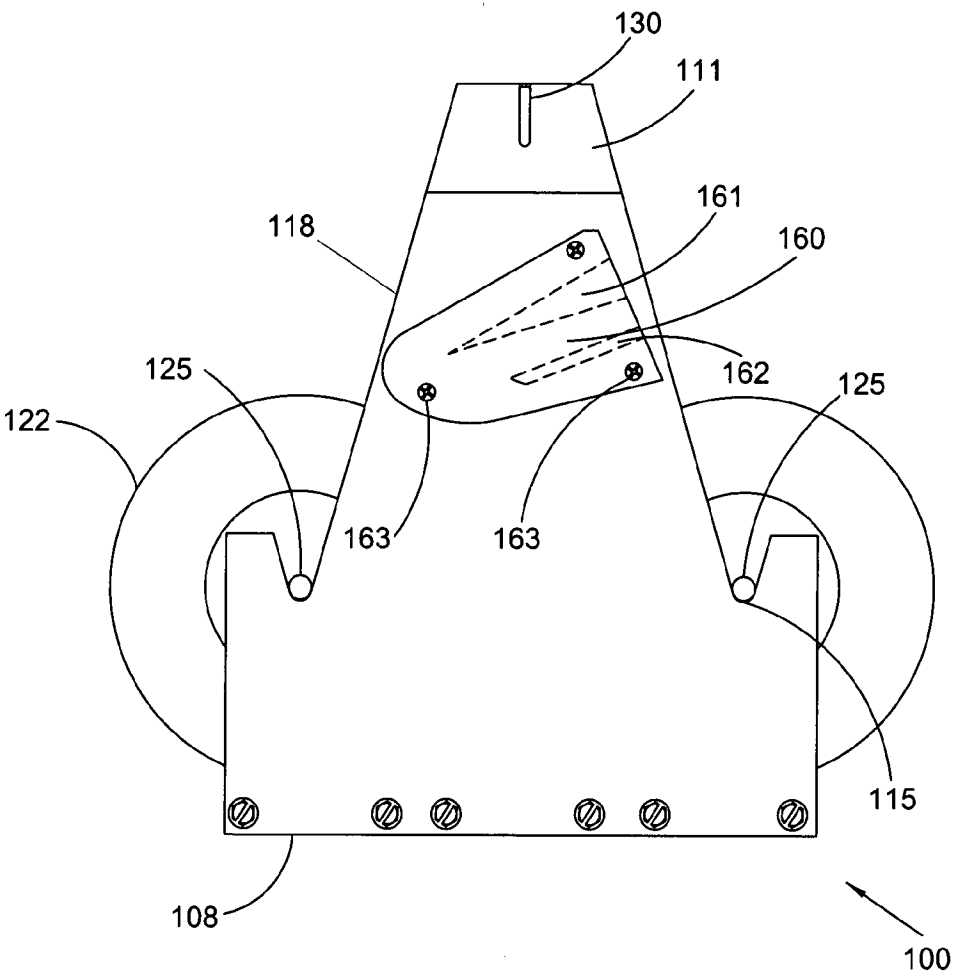
FIG. 5 is a rear view of the portable yarn carryall device in accordance with some of the exemplary embodiments of the present invention.
Figure 6:
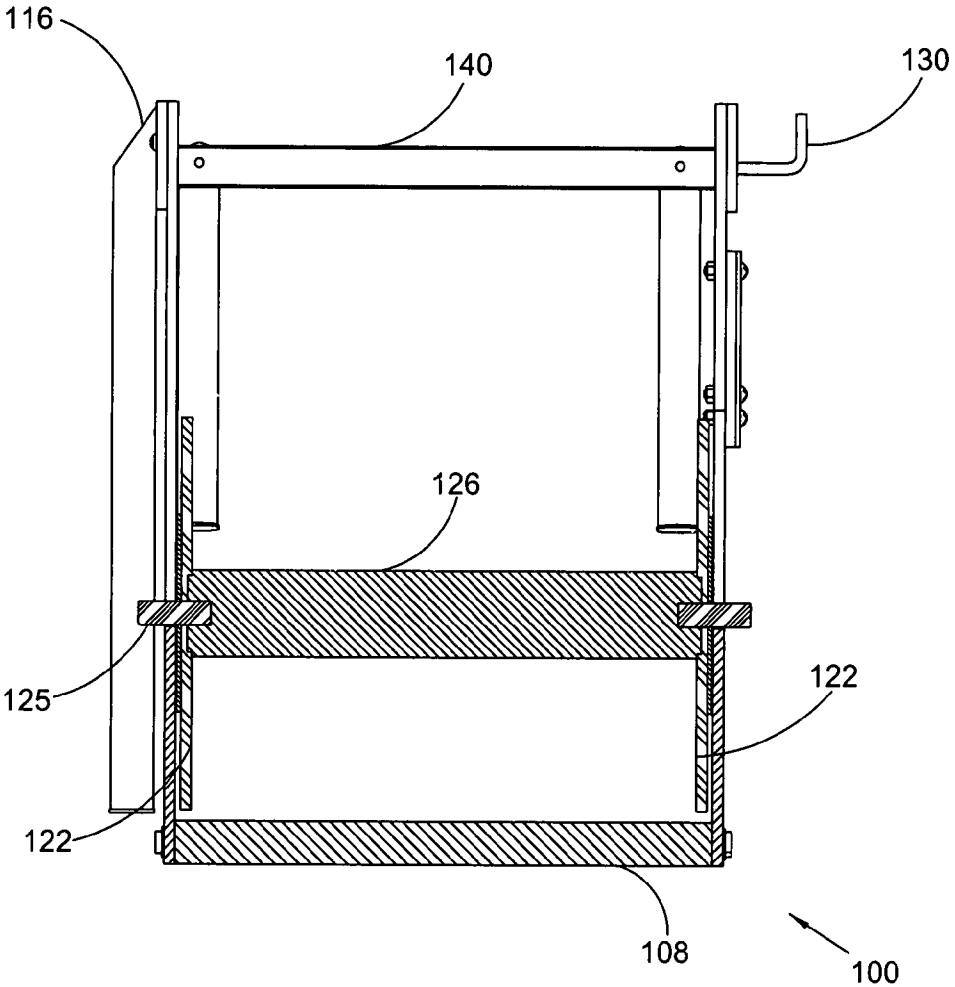
FIG. 6 is a cross-sectional view of the portable yarn carryall device in accordance with some of the exemplary embodiments of the present invention.

As seen in FIGS. 1, 4 and 5, each side wall member 110 has an upper portion 176 which has a quasi-triangular shape with a top edge 119 of the side wall member 110 being truncated. More specifically, the upper portion 176 has a trapezoidal shape. The side wall member 110 has a bottom portion 178 which has a width that is approximately the same as the width of the base member 108 to which the side wall member 110 is attached. An upper end 112 of the bottom portion 178 has at least two spaced-apart grooves or shaft seating members 115. Each groove or shaft seating member 115 in one of the side wall member 110 is aligned (horizontally and vertically) with another groove or shaft seating member 115 in the other side wall member 110. The two groove or shaft seating members 115 that are aligned create a pair of grooves, such that said pair of grooves provide a cradle to support and rotate therein a respective one spool or skein 120.

The grooves or shaft seating members 115 are located in both side wall members 110 and allow the spool or skein 120 to rotate freely when operatively positioned. The grooves or shaft seating members 115 are V-shaped. Nonetheless, a U-shape or other shapes may be used. The grooves are formed by extending a sloped edged of the upper portion 176 into the bottom portion 178 a predetermined distance away from a vertical edge of the bottom portion 178 wherein such sloped edge being a first leg of the V-shape. The first leg of the V-shape is the furthest from the vertical edge of the bottom portion. The second leg of the V-shape is the closest from the vertical edge. The apex of the V-shape lies below the upper end 112.

A support pad 111 (FIG. 5) is provided at a top end of the upper portion 176 of each side wall member 110. In the exemplary embodiment, a top edge of the support pad 111 is flush with top edge 119. The side edges of the support pad 111 are also flush with the sloped side edges of the side wall member 110. The support pad 111 has a generally trapezoidal shape.

The support pad 111 on one of the side wall members 110 has coupled thereto one or more of the first knitting accessory holders (e.g. knitting or crochet needle holders 116). In the exemplary embodiment, there are two knitting or crochet needle holders 116 affixed to the side wall member 110 via fasteners 117. Fasteners 117 may include a screw or bolt. Nonetheless, hook and loop fasteners, or other means of affixing holders 116 to the side wall member 110 may be used.

The other support pad 111 is affixed to the other side wall member 110 and has coupled thereto the third knitting accessory holder (e.g., at least one hook or means for hanging 130) to hold, hang or support a work or knitting tools or supplies.

The side wall member 110 that has the third knitting accessory holder also has coupled thereto the second knitting accessory holders 161 and 162. Holder 161 holds and stores a pair of scissors while holder 162 holds and stores a needle. The holders 161 and 162 are channels contoured to receive the blades of a closed pair of scissors and a needle, respectively. The channels are covered with a cover or plate 160. The cover or plate 160 may be made of transparent material such as a clear plastic. The cover or plate 160 is affixed to the structure defining the second knitting accessory holders 161 and 162 and the side wall member 110 via fasteners 163.

Figure 3:
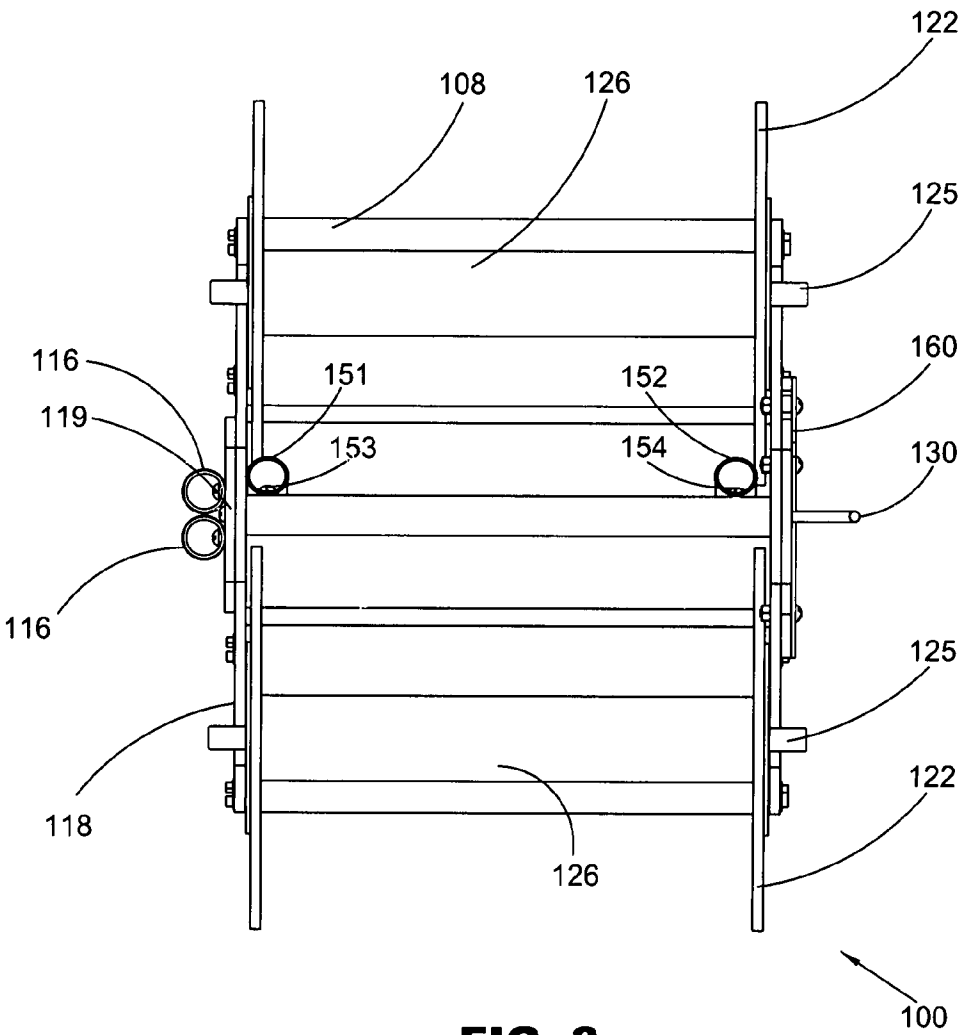
FIG. 3 is a top view of the portable yarn carryall device according to some exemplary embodiments of the present invention.
Figure 7:
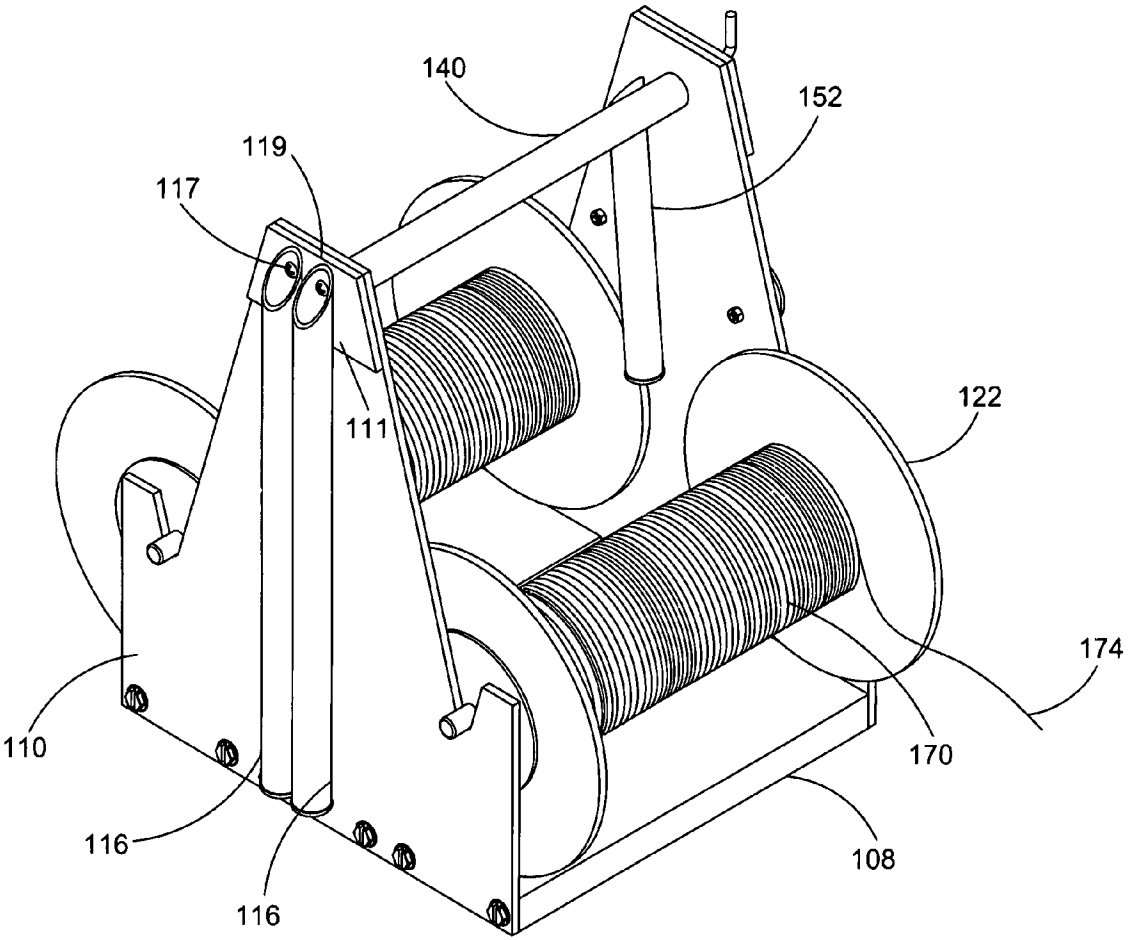
FIG. 7 is a front perspective view the portable yarn carryall device with yarn installed in accordance with some of the exemplary embodiments of the present invention.

As best seen in FIGS. 3, 4, and 7, the portable yarn carrying device 100 includes fourth and fifth knitting accessory holders. In the exemplary embodiment, the forth and fifth knitting accessory holders include knitting/crocheting needle holders 151 and 152. However, the forth and fifth knitting accessory holders are coupled or affixed to and suspended from the carrying handle 140 via fasteners 153 and 154, respectively. The fasteners 153 and 154 may be screws or bolts. Nonetheless, the forth and fifth knitting accessory holders may be positioned at other locations on the chassis. For example, the fourth and fifth knitting accessory holders may be attached on an interior side of the side wall members 110 opposite the side of the first knitting accessory holders.

The knitting/crocheting needle holders 116, 151 and 152 are elongated tubular members with a closed bottom and top angular openings. In the exemplary embodiment, the needle holders 116, 151 and 152 are made of ½ diameter pipe of plastic, polymer or suitable material. The knitting/crocheting needle holders 116, 151 and 152 may be made of a variety of materials include man-made material, natural material or a combination of man-made and natural material.

Returning again to FIGS. 1-6, since each spool or skein is essentially the same only one such spool or skein will be described in detail. Each spool or skein 120 includes an elongated hollow or solid cylindrically shaped structure, spool structure or shaft 126 (hereinafter referred to as the "spool shaft 126"). Each distal end of the spool shaft 126 is coupled, interconnected or affixed in a center of spool flanges 122 having a diameter greater than the diameter of the spool shaft 126. The diameter of the spool flange 122 allows a portion of the yarn to be wound around the spool shaft 126 and not slip off of the distal ends of the spool shaft 126. The distal ends of the spool shaft 126 are coupled to the interior sides of the spool flanges 122.

The exterior side of each spool flange 122 has coupled or affixed thereto chassis coupling pins or shafts 125. The longitudinal axis of the chassis pins or shafts 125 is aligned with the longitudinal axis of the spool shaft 126. Each chassis coupling pin or shaft 125 is removably and rotatably seated or cradled in the grooves or shaft seating members 115 so that the chassis coupling pin or shaft 125 of each flange 122 is disposed essentially parallel to the base member 108 and spaced there above. The chassis coupling pins or shafts 125 are adapted to hold the spool shaft 126. The chassis coupling pins or shafts 125 are coupled axially to the spool shaft 126 and rotate the spool shaft 126 between the side wall members 110 as the pins or shafts 125 rotate within the grooves or shaft seating members 115.

The flanges 122 are configured to be positioned on the interior sides of the side wall members 110. The spool shaft 126 has coupled thereto a screw 128, post or structure to loop an end of yarn therearound.

As can be appreciated, the spools or skeins 120 are each horizontally cradled by the chassis of the carryall device 100. The force of gravity allows the spools or skeins 120 to remain seated until removed by the user.

The spool or skein 120 may be rotated manually or mechanically in the grooves or shaft seating members 115 via the chassis coupling pins or shafts 125 so as to load, spool or wind a portion of yarn around an empty portion of the spool shaft 126. Each spool or skein 120 may be loaded with one or more packs or bundles of yarn. The yarn may be already on a spool or skein and may be off-loaded and loaded or wound on one of the spools or skeins 120. Nonetheless, yarn pre-packed on spools or skeins may be used with the carryall device 100 provided chassis pins or shafts (similar to chassis pins or shafts 125) are available for attachment to the pre-packed spool or skein of yarn.

In order to load yarn onto the spool shaft 126, a looped end of the yarn is wound around screw 128. Then the user manually or mechanically rotates the spool or skein 120 as the chassis coupling pins or shafts 125 rotate in grooves or shaft seating means 115. The rotation continues until all the yarn is loaded or the amount desired is loaded. Any remaining portion of the spool shaft 126 may be loaded with another pack of yarn. The new pack of yarn may be a different color, size or texture or the same as the previous yarn. This procedure can be repeated with the second spool or skein 120. The both spools can rotate either clockwise or counter-clockwise to release the yarn. By maintaining the flanges 122 at both side of spool shaft 126, the user may place multiple packs of yarn one after another in continuance and keep the yarn separated so as to eliminate tangling.

For example, multiple spools of yarn (at least to common yarn) are commonly used in knitting and crocheting a work (e.g., hat, gloves, socks, scarves, sweaters, etc.). Thus, a user may want to use two spools of yarn (same colors or different colors/textures) for the same product. The multiple spools 120 of the present invention allow a user to place two or more yarns separately with different and separate feeds (different spools or skeins) or the different yarns may be loaded on the same spool or skein 120.

An empty yarn spool can easily be interchanged with a filled spool or skein during the process. When knitting or crocheting, an external force or pull is applied to the yarn to rotate horizontally the spools or skeins 120 individually or simultaneously clockwise or counterclockwise as per user's requirement to supply the yarn without getting tangled in the process.

In the exemplary embodiment, the spool shaft 126 has approximately 6" circumference and approximately 10" to 15". The size of the spool shaft 126 provides a place to roll upon one or more packs of pre-packaged spools or skein one after another.

FIG. 7 is a front perspective view the portable yarn carryall device 700 with yarn 170 and 174 installed in accordance with some of the exemplary embodiments of the present invention. Many of the same elements disclosed in FIGS. 1-6 are also shown in FIG. 7. Thus, no further discussion is necessary. In FIG. 7, the spools or skeins 120 (FIG. 1) are shown loaded with one or more portions of yarn 170 or 174. The yarn 170 and 174 are distributed over the length of the spool shaft 126 (FIG. 3).

In one embodiment, replacement spools may be substituted for spools 120. A replacement spool would be a filled spool with a size and shape configured to be freely rotated in the grooves or shaft seating means 115. The replacement spools may be unfilled spools 120 so that a filled spool 120 can be interchanged when creating an article.

Figure 8:
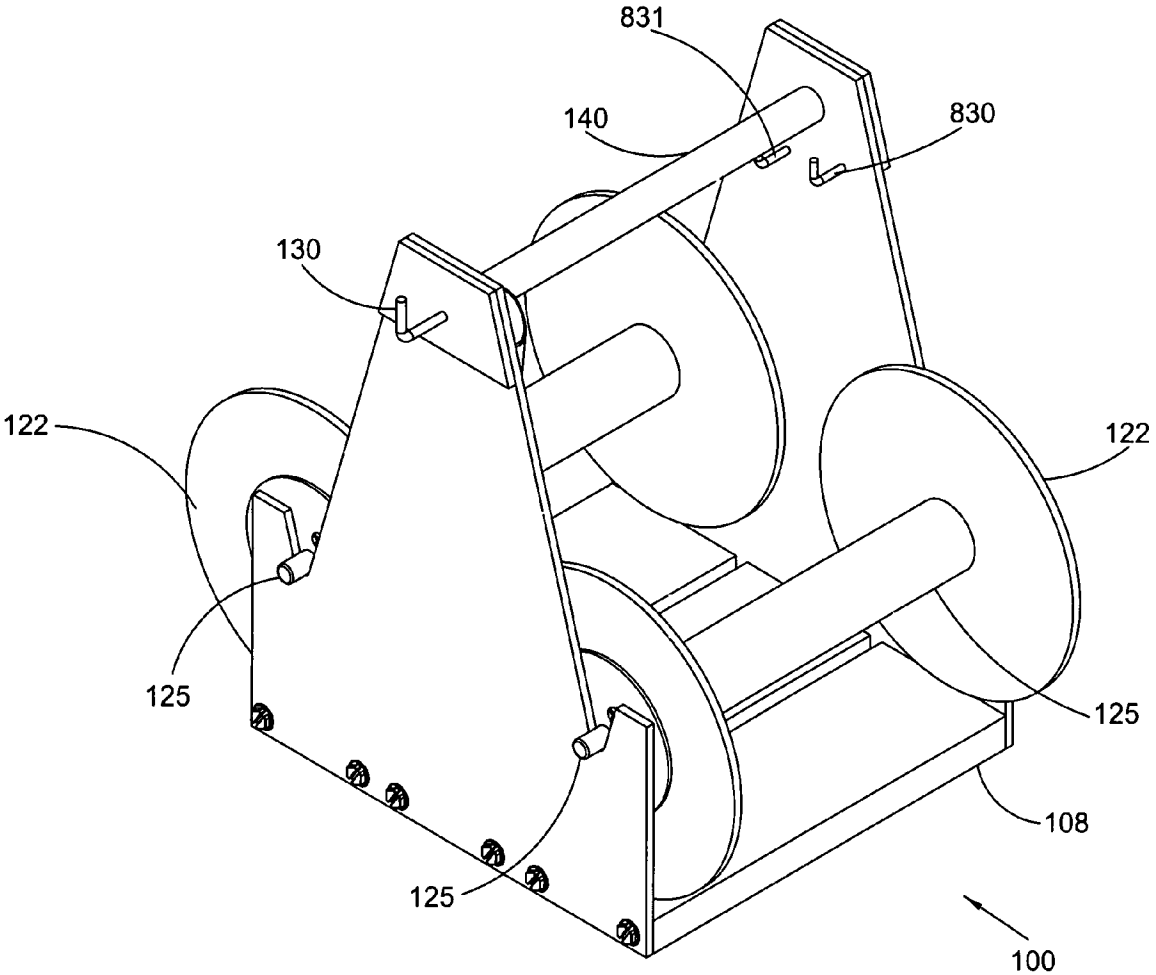
FIG. 8 is a perspective view of another embodiment of the portable yarn carryall device in accordance with some of the exemplary embodiments of the present invention.

FIG. 8 is a perspective view of another embodiment of the portable yarn carryall device 100 in accordance with some of the exemplary embodiments of the present invention. In FIG. 8, the yarn carryall device 100 is provided with two hanging means 830 and 831 on the interior side of at least one side wall member 110. The two hanging means 830 and 831 or hooks are in proximity to the carrying handle 140. The two hanging means 830 and 831 are knitting accessory holders that may be used to hand a work or partially completed work, supplies, accessories, tools, etc.

Figure 9:
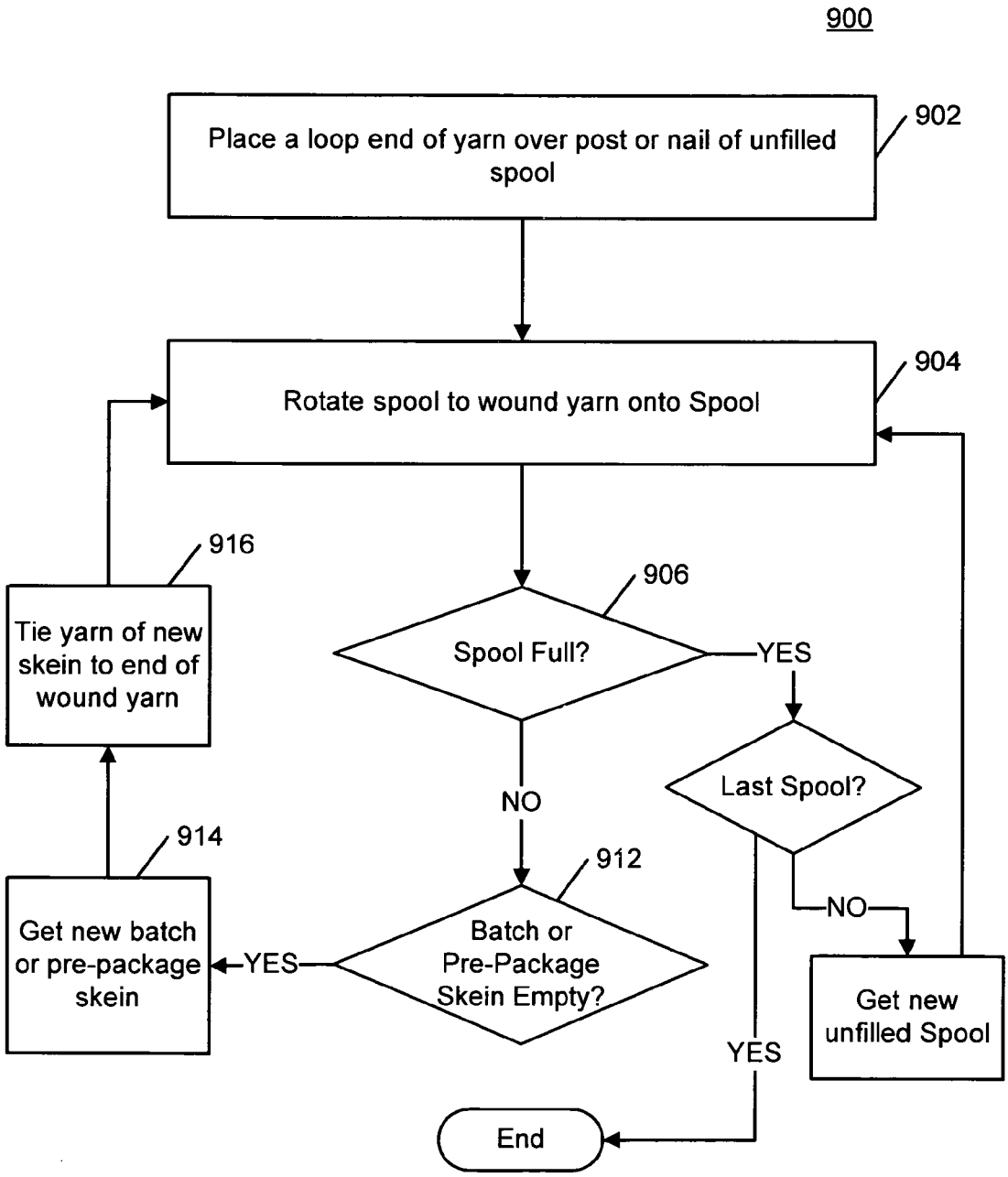
FIG. 9 is a flow chart showing an exemplary process for using the portable yarn carryall device in accordance with some exemplary embodiments of the present invention.

FIG. 9 is a flow chart showing an exemplary process 900 for using the portable yarn carryall device 100 or 700 in accordance with some exemplary embodiments of the present invention. As shown by the flowchart of FIG. 9, the process 900 includes use of the yarn carryall device 100 for easy supply of multiple yarns from multiple spools of yarn.

The process 900 begins at step 902 where the knitter places a loop of the end of yarn of a skein over the head of a screw 128 on a spool 120. The spool 120 can be unfilled and may serve as a refillable spool. Spool 120 may be emptied. Step 902 is followed by step 904 where, the spool is rotated to wound a portion or all of a supply or batch of yarn onto a spool 120. As the spool 120 is rotated, the yarn to taken up or taken off of the pre-packaged spool or skein.

At step 906 a determination is made whether the spool if full. If the determination is "YES," then step 906 is followed by step 908 where a determination is made whether the full spool is the last spool. If the determination is "YES," the process 900 ends.

However, if the determination is "NO," step 908 is followed by step 910 where a new unfilled spool may be retrieved. Step 910 loops back to step 902 where the process is repeated.

Returning again to step 906, if the determination is "NO," a determination is made whether a pre-packaged spool or skein is empty (such as the result of off-loading yarn onto spool or skein 120) or the batch of yarn is depleted at step 912. If the determination is at step 912 is "NO," the method returns to step 906 until the spool if full or the batch or pre-packaged spool of yarn is empty. However, if the determination is "YES," then step 912 is followed by step 914 when a new batch of yarn is retrieved. The new batch of yarn may be in a batch of yarn or yarn pre-packaged on a spool or skein. Step 914 is followed by block 916 where a loop end of the yarn is placed on post, nail or screw 128 to secure the yarn. Step 916 loops back to step 904 where the process 900 is continued.

During step 904, the user may use a drill to rapidly rotate the spool or skein 120 or manually rotate the spool or skein. It should be noted, that the grooves or shaft seating members 115 are configured to be attached to a drill in a manner to be rotated.

In addition to the advantages described above, the method of use includes using the portable yarn supply device 100 to carry multiple spools of yarn for easy supply of yarn in the knitting and crocheting operation. The hanging means is provided to hang half completed knitting work or other suitable objects at time of knitting operation. For example, if the user is knitting a hat or something else that can be set onto a frame, then the frame can be hung on the side of the carryall device 100 to keep the knitting that is being worked on with the yarn in a convenient carryall device 100—knitter need not to worry about the hat, the sweater, the booties, etc. getting all tangled up or misplaced.

According to still further exemplary embodiments, the yarn carryall device 100 may be hanged with a hanger or placed in a small hard case that can be easily stowed in most any vehicle. A device 100 may be packaged with a rapid access tool to optimize tools needed for extrication and such packaging provides one container for immediate use.

According to some of the exemplary embodiments, the yarn carryall device 100 may be a variety of sizes to facilitate two or more spools having different thicknesses and/or of different compositions. Other embodiments include simultaneous use of a more than two yarn carryall devices 100 to supply total four yarns for knitting process. Still further, other exemplary embodiments include multiple hook means for handing different thing used in knitting operation.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A yarn carryall device comprising:

a portable chassis comprising at least one spool cradle, the at least one spool cradle being configured to freely rotate therein at least one spool in a horizontal orientation to dispense yarn; and a plurality of knitting accessory holders coupled to said portable chassis, wherein the portable chassis comprises:

a base member, first and second parallel side wall members coupled perpendicularly to opposite ends of the base member, wherein the at least one spool cradle comprises:

a first groove in the first side wall member, the first groove having a generally v-shaped design, and a second groove formed in the second side wall member, the second groove having a generally v-shaped design, the first groove and the second groove being aligned to form a generally v-shaped spool cradle configured to receive ends of a spool, and a carrying handle coupled to and between the side wall members.

2. The device according to claim 1, wherein the at least one spool cradle further comprises:

a third groove formed in the first side wall member in spaced relation to the first groove, the third groove having a generally v-shaped design; and a fourth groove formed in the second side wall member in spaced relation to the second groove, the fourth groove having a generally v-shaped design, the third groove and the fourth groove being aligned to form a second spool cradle configured to receive ends of a second spool.

3. The device according to claim 1, wherein the plurality of knitting accessory holders comprises at least one knitting needle holder coupled to at least one side wall member of the first and second side wall members.

4. A yarn carryall device comprising:

a portable chassis comprising at least one spool cradle, the at least one spool cradle being configured to freely rotate therein at least one spool in a horizontal orientation to dispense yarn; and a plurality of knitting accessory holders coupled to said portable chassis, wherein the portable chassis comprises:

a base member;

first and second parallel side wall members coupled perpendicularly to opposite ends of the base member wherein the at least one spool cradle comprises:

a first groove formed in the first side wall member, the first groove having a generally v-shaped design, and a second groove formed in the second side wall member, the second groove having a generally v-shaped design, the first groove and the second groove being aligned to form a generally v-shaped spool cradle configured to receive ends of a spool; and a carrying handle coupled to and between the side wall members, wherein the at least one spool cradle further comprises:

a third groove formed in the first side wall member in spaced relation to the first groove, the third groove having a generally v-shaped design; and a fourth groove formed in the second side wall member in spaced relation to the second groove, the fourth groove having a generally v-shaped design, the third groove and the fourth groove being aligned to form a second spool cradle configured to receive ends of a second spool, wherein the plurality of knitting accessory holders comprises at least one knitting needle holder coupled to a carrying handle.

5. The device according to claim 4, wherein the plurality of knitting accessory holders further comprise at least one hook configured to hang knitting supplies, accessories or a work.

6. A device according to claim 1 or 4, wherein each spool of the at least one spool comprises:

a spool shaft;

two parallel flanges having a first side coupled to opposite ends of the spool shaft; and two chassis coupling pins, each pin being coupled to a respective one second side of the flanges and being configured to rotate in the first and second grooves or the third and fourth grooves.

7. A yarn carryall device according to claim 1 or 4, wherein the two chassis coupling pins are configured to support the spool shaft horizontally and in parallel to the base member.

8. A yarn carryall device according to claim 1 or 4, wherein the spool shaft includes a screw for attachment of a loop end on the yarn.

9. A method for winding, holding, and supplying of yarn, the method comprising the steps of:

a. wrapping an end of yarn of a batch over a head of a screw on a spool;

b. winding the yarn upon the spool, the yarn winds winding around the spool until a portion of the yarn is wrapped around the spool;

c. repeat repeating step (b) until the spool is full, the yarn is depleted or the portion is reached;

d. after step (c), placing the spool in a horizontal orientation in a v-shaped cradle associated with a portable carryall device;

e. obtaining a second batch of yarn;

f. repeating the steps (b)-(d) using another spool;

g. performing a knitting or crocheting process with the yarn on the spools;

h. retrieving knitting supplies, tools or accessories for the knitting or crocheting process from at least one knitting accessory holder, wherein the portable carryall device comprises a base member, first and second parallel side wall members coupled perpendicularly to opposite ends of the base member, wherein the at least one spool cradle comprises a first groove in the first side wall member, the first groove having a generally v-shaped design, and a second groove formed in the second side wall member, the second groove having a generally v-shaped design, the first groove and the second groove being aligned to form a generally v-shaped spool cradle configured to receive ends of a spool, and a carrying handle coupled to and between the side wall members.

* * * * *